United States Patent [19]

Osteen

[11] 4,123,690

[45] Oct. 31, 1978

[54] DISCHARGE LAMP BALLAST CIRCUIT

[75] Inventor: Mitchell M. Osteen, Zirconia, N.C.

[73] Assignee: General Electric Company, N.Y.

[21] Appl. No.: 775,005

[22] Filed: Mar. 7, 1977

[51] Int. Cl.[2] ..... H05B 41/16

[52] U.S. Cl. ..... 315/258; 315/177; 315/247; 315/254; 315/276; 315/283; 315/324; 315/DIG. 5

[58] Field of Search ..... 315/177, 183, 247, 254, 315/258, 276, 283, 324, DIG. 5

[56] References Cited

U.S. PATENT DOCUMENTS

| | | | |
|---|---|---|---|
| 3,092,754 | 6/1963 | Fales | 315/177 X |
| 3,873,910 | 3/1975 | Willis | 315/278 X |
| 3,931,543 | 1/1976 | Nuckolls | 315/177 |

*Primary Examiner*—Eugene R. LaRoche
*Attorney, Agent, or Firm*—Sidney Greenberg

[57] ABSTRACT

Electrical ballast circuit of improved power factor for operating gaseous discharge lamps. Two discharge lamps are respectively connected to two inductively coupled induction coils for obtaining high power factor without the use of capacitors.

8 Claims, 2 Drawing Figures

DISCHARGE LAMP BALLAST CIRCUIT

The present invention relates to discharge lamp operating circuits, and more particularly concerns alternating current inductive ballast circuits for lamps.

It is an object of the invention to provide a discharge lamp operating circuit of improved power factor without the use of a capacitor.

Another object of the invention is to provide a circuit of the above type wherein a plurality of discharge lamps are employed.

Other objects and advantages will become apparent from the following description and the appended claims.

With the above objects in view, the present invention in one of its aspects relates to lamp operating apparatus comprising, in combination, an alternating current source, a first circuit comprising a first inductor and a first gaseous discharge lamp connected in series across the alternating current source, and a second circuit comprising a second inductor inductively coupled to the first inductor and a second gaseous discharge lamp connected across the second inductor, the current in the second circuit being derived solely from the inductive coupling of the first and second inductors.

The invention will be better understood from the following description taken in conjunction with the accompanying drawing, in which.

As well understood in the art, induction components used in ballasts for gaseous discharge lamps inherently cause low power factor in the circuits, and typical inductive ballast circuits provide only about 40% power factor. In the past, capacitors have been employed in such circuits for power factor correction. Among the disadvantages of low power factor are that more voltamperes must be used per unit of illumination, more expensive power generating equipment must be provided, and wiring is generally of larger size in order to carry the larger current needed. However, the addition of capacitors to improve power factor is not fully satisfactory because of the disadvantages of added cost and reduced reliability.

In accordance with the present invention, a ballast circuit for operating gaseous discharge lamps of various types is provided which improves the line power factor without capacitors, as heretofore conventionally employed for this purpose.

Figure 1:
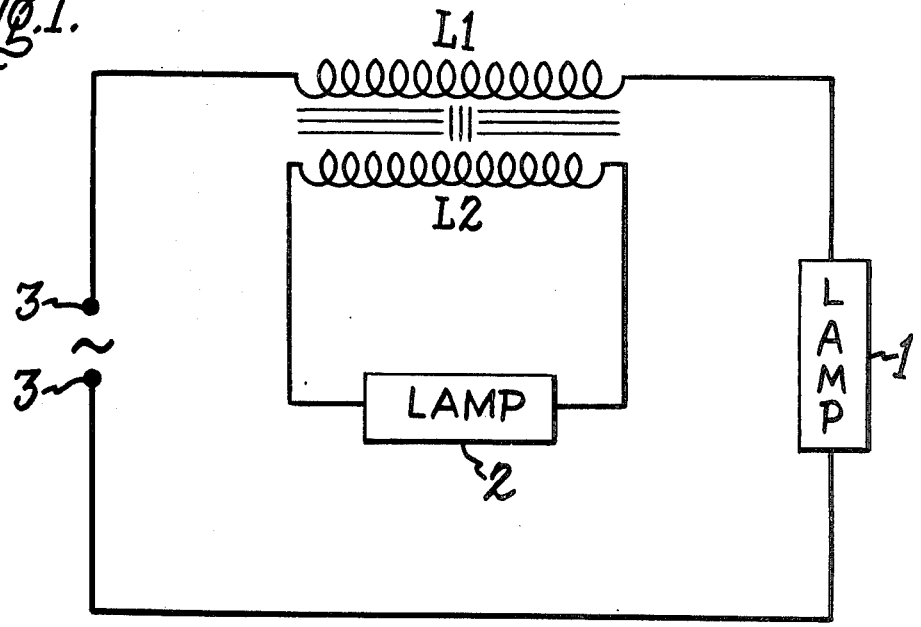
FIG. 1 is a circuit diagram showing an embodiment of the invention.

Referring now to the drawing, FIG. 1 shows a lamp operating circuit constructed in accordance with the invention comprising terminals 3 of a source of alternating current, and induction coil L1 and lamp 1 connected in series across the source terminals 3. Induction coil L2 is inductively coupled to induction coil L1, and discharge lamp 2 is connected across coil L2.

Lamps 1 and 2 may be of the same or different types of gaseous discharge lamps, subject to the considerations mentioned hereinafter, and may, for example, be metal halide, mercury vapor or high pressure sodium vapor discharge lamps of known type.

Figure 2:
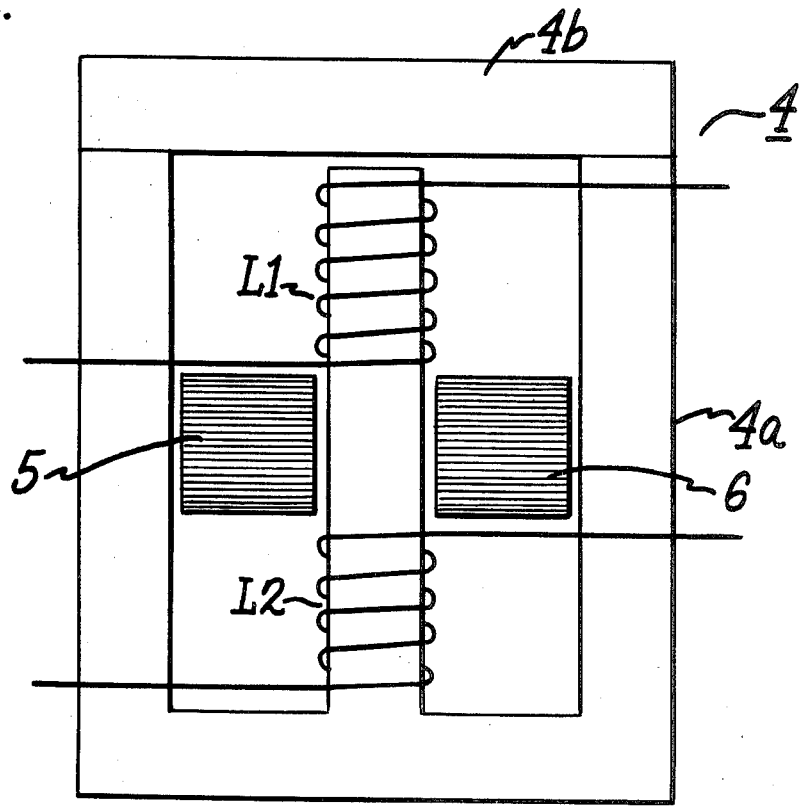
FIG. 2 is a schematic diagram of a ballast device which may be employed in accordance with the invention.

FIG. 2 shows a typical form of ballast device which may be employed in practicing the present invention, wherein induction coils L1 and L2 are arranged on a magnetic core 4 of E-I type, the coils being wound on the center core leg on opposite sides of magnetic shunts 5 and 6 respectively placed between the center leg and the outer legs. Preferably an air gap is provided between the end of the center leg and yoke **4*b* of the magnetic core as shown, thereby resulting in a magnetizing current being added to lamp 1 and providing a leading phase angle of the current in lamp 2 relative to the current in lamp 1**.

Other forms of magnetic core may be used, such as U-I type, as disclosed for example in the patent to Willis U.S. Pat. No. 3,873,910, assigned to the same assignee as the present invention, wherein a similar arrangement of induction coils is shown.

By virtue of the circuit arrangement shown in FIGS. 1 and 2, the current supplied to lamp 2 by induction coil L2 is substantially out of phase with and leading the current supplied to lamp 1 through induction coil L1, and an improvement in power factor is obtained by virtue of the phase difference between these currents. The current through lamp 2 leading the current through lamp 1 serves, in effect, as a capacitor to the line.

In a particular circuit constructed in accordance with the invention, copper wire induction coils were employed wherein the ratio of turns of coil L1 to coil L2 was about 1.4 to 1, lamp 1 was a metal halide discharge lamp and lamp 2 was a mercury vapor discharge lamp. In the operation of this circuit, lamp 1 exhibited the values of 137 volts, 1.45 amperes and 172 watts, while lamp 2 was characterized by 133 volts, 1.52 amperes and 180 watts. This combination when operated at a line voltage of 382 volts, resulted in a line current of 1.40 amperes and 373 watts, producing a power factor of about 70%.

In contract, where a single lamp of the above type is operated with the same line voltage using a linear reactor, e.g., an induction coil, without any power factor correction capacitor, the power factor obtained was only 41%.

It has been found, in work done with the above described circuit, that lamp 1 should be of higher voltage than lamp 2 in order to obtain greater power factor correction. For similar purposes, where two lamps of different wattages are used, the higher wattage lamp would be lamp 2.

The actual turns ratio between coils L1 and L2 which is used in practice is dependent on such factors as the starting voltage requirements for each lamp, the line voltage for ballasting, and the voltage and current difference between the two lamps.

Although not shown, a starting aid circuit may be incorporated in the described lamp operating circuit for starting high pressure sodium vapor lamps or other lamps requiring higher voltages for ignition. Such a starting circuit is shown, for example, in Nuckolls U.S. Pat. No. 3,963,958, assigned to the same assignee as the present invention, as well as in other places in the art.

By virtue of the invention, capacitors may be dispensed with for power factor correction purposes, and thereby achieve improved power factor at lower cost and with increased reliability. However, where desirable to obtain even greater power factor correction, a capacitor may be incorporated for this purpose in a conventional manner in the described circuit, but such a capacitor may be of smaller size, and hence of lower cost, than would otherwise be required.

An additional advantage obtained in connection with the invention is that because of the phase difference between the currents to the respective lamps, the undesirable stroboscopic or flickering effects sometimes observed in other types of lamp installations are largely avoided.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Lamp operating apparatus comprising, in combination, an alternating current source, a first circuit comprising a first inductor and a first gaseous discharge lamp connected in series across said alternating current source, and a second circuit comprising a second inductor inductively coupled to said first inductor and a second gaseous discharge lamp connected across said second inductor, the current in said second circuit being derived solely from the inductive coupling of said first and second inductors, and means providing for the output current of said second circuit to lead the output current of said first circuit and for thereby improving the power factor of said alternating current source without using a capacitor therefor.

2. Apparatus as defined in claim 1, said first lamp having a higher voltage than said second lamp.

3. Apparatus as defined in claim 1, said inductors comprising wound coils, the turns ratio of said first inductor relative to said second inductor being greater than 1.

4. Lamp operating apparatus comprising, in combination an alternating current source, a first circuit comprising a first inductor and a first gaseous discharge lamp connected in series across said alternating current source, and a second circuit comprising a second inductor inductively coupled to said first inductor and a second gaseous discharge lamp connected across said second inductor, the current in said second circuit being derived solely from the inductive coupling of said first and second inductors, the output current of said second circuit leading the output current of said first circuit, whereby the power factor of said alternating current source is improved, said apparatus including a magnetic core forming a closed magnetic circuit and having spaced leg portions, said first and second inductors respectively comprising first and second coils wound on at least one of said leg portions and substantially spaced from each other.

5. Apparatus as defined in claim 4, said core having magnetic shunt means extending between said spaced leg portions, said first and second coils being arranged on opposite sides of said magnetic shunt means.

6. Apparatus as defined in claim 1, said second lamp having a higher wattage than said first lamp.

7. Electrical load operating apparatus comprising, in combination, an alternating current source, a first circuit comprising a first inductor and a first load connected in series across said alternating current source, and a second circuit comprising a second inductor inductively coupled to said first inductor and a second load connected across said second inductor, the current in said second circuit being derived solely from the inductive coupling of said first and second inductors, and means providing for the output current of said second circuit to lead the output current of said first circuit and for thereby improving the power factor of said alternating current source without using a capacitor therefor.

8. Apparatus as defined in claim 7, wherein at least one of said loads is a gaseous discharge lamp.

* * * * *